United States Patent [19]

Roberts

[11] Patent Number: 5,044,617

[45] Date of Patent: Sep. 3, 1991

[54] SHEET FOLDING APPARATUS HAVING AIR DEFLECTOR MEANS

[75] Inventor: Randall J. Roberts, Kingsport, Tenn.

[73] Assignee: M.B.O. Binder and Company of America, Cinnaminson, N.J.

[21] Appl. No.: 316,657

[22] Filed: Feb. 28, 1989

[51] Int. Cl.[5] ..... B42C 1/00

[52] U.S. Cl. ..... 270/45; 493/420

[58] Field of Search ..... 270/32, 37, 45, 46; 493/418, 419, 420, 450

[56] References Cited

U.S. PATENT DOCUMENTS

| | | | |
|---|---|---|---|
| 2,699,331 | 1/1955 | McGarvey | 493/450 |
| 3,773,315 | 11/1973 | Tsien | 493/450 |
| 3,901,501 | 8/1975 | Kistner | 493/450 |
| 4,601,695 | 7/1986 | Pazzi | 493/418 |
| 4,850,945 | 7/1989 | Whittenberger | 493/420 |

*Primary Examiner*—Edward K. Look
*Assistant Examiner*—Therese M. Newholm

[57] ABSTRACT

A sheet folding apparatus having a feed roller device for grasping and propelling a sheet forward, a first gate for receiving a leading portion of the propelled sheet and stopping the same at a predetermined distance therein to cause a first buckle in the trailing portion of the sheet, a first fold roller device for grasping the sheet at the first buckle and propelling the sheet with the first buckle leading into a second gate and stopping the same at a predetermined distance therein to cause a second buckle in the trailing portion of the sheet, the first and second buckles forming opposed overleaves having their inner edges in juxtaposition, a second fold roller device for grasping the sheet at the second buckle and propelling the sheet with the second buckle leading into a third gate and stopping the same at a predetermined distance therein to cause a third buckle in the trailing portion of the sheet, a third fold roller device for grasping the sheet at the third buckle and propelling the sheet with the third buckle leading through the exit of the folding operation, an air jet device disposed in close proximity to the inner edges and adjacent to the entry of the third fold roller device and adapted to apply air pressure to the inner edges in a direction tending to force them flat against the underlying sheet portion as the third buckle is being formed and is being engaged by the third fold roller device.

8 Claims, 9 Drawing Sheets

SHEET FOLDING APPARATUS HAVING AIR DEFLECTOR MEANS

This invention concerns a machine or apparatus for folding sheet material such as paper or other readily deformable and creaseable items, and particularly concerns improvements to the type of folding apparatus known to the art as "buckle folders".

In the art of buckle folding, a large variety and complexity of apparatus is known as exemplified by U.S. Pat. Nos. 4,225,128 and 4,647,029 and British Patent 391,549, the disclosures of which concerning basic operation, base framing or supporting structure, roller structure, paper guiding structure, powering, and the like are incorporated herein by reference.

In such prior art devices, particularly for folding brochures or the like, wherein the paper is folded in the center and also on each side of center approximately half way to the edges to provide two opposed inner-leaves or inner panels, there is great difficulty in preventing the free edges of the panels from becoming bent or dog-eared or the like since the free edges are difficult to confine on their way through the final center buckling and creasing operation. Such will become clear from the drawings and description thereof hereinafter given. As a consequence of this and other difficulties common to the presence of such free edges, it has been conventional in the art to dimension the inner panels such that upon center folding or center buckling of the brochures or the like, the free edges of the panels are spaced from each other a substantial distance, e.g., ¼ to ½ inch, in order to minimize the chances of the edges coming into contact with each other and producing an undesired crease, fold, dog-ear or crumpling thereof, or to prevent either or both free edges from being pulled prematurely through the center folding rollers, or to prevent the trailing panel free edge to be forced into the final gate with, of course, disastrous consequences to the work piece. The net result of so diminishing the size of the panels is, of course, a loss of advertising space or the like. Another adverse consequence of such dog-earring or the like is that maximum operation speeds of the machine cannot be realized in that slowing down the passage of the workpiece therethrough appears to alleviate the problems to some extent.

Objects therefore of the present invention are to provide buckle folding type apparatus which essentially obviates the aforementioned difficulties normally attendant to triple folding brochures or the like, to provide such apparatus having unusually high operating speeds, and to provide such apparatus which is conveniently adaptable to existing folding machines.

These and other objects hereinafter appearing have been attained in accordance with the present invention through the method and means broadly defined herein as a sheet folding apparatus having feed roller means for grasping and propelling a sheet forward, first gate means for receiving a leading portion of said propelled sheet and stopping the same at a predetermined distance therein to cause a first buckle in the trailing portion of said sheet, first fold roller means for grasping said sheet at said first buckle and propelling said sheet with said first buckle leading into second gate means adapted to stop the same at a predetermined distance therein to cause a second buckle in the trailing portion of said sheet, said first and second buckles forming opposed panels having their inner edges in juxtaposition, second fold roller means for grasping said sheet at said second buckel and propelling said sheet with said second buckle leading into third gate means adapted to stop the same at a predetermined distance therein to cause a third buckle in the trailing portion of said sheet, third fold roller means for grasping said sheet at said third buckle and propelling said sheet with said third buckle leading through the exit of the folding operation, air jet means disposed in close proximity to said inner edges and adjacent to the entry of said third fold roller means and adapted to apply air pressure to said inner edges in a direction tending to force them flat against the underlying sheet portion as said third buckle is being formed and is being engaged by said third fold roller means.

In certain preferred embodiments:

the jet means is mounted for movement toward and away from the nip of said third fold roller means;

the invention will be further understood from the following drawings and description, wherein.

Figure 1:
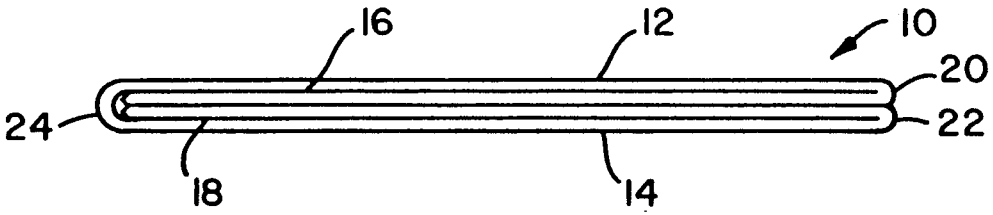
FIG. 1 is an enlarged end view of a brochure having the triple fold in accordance with the present invention.
Figure 2:
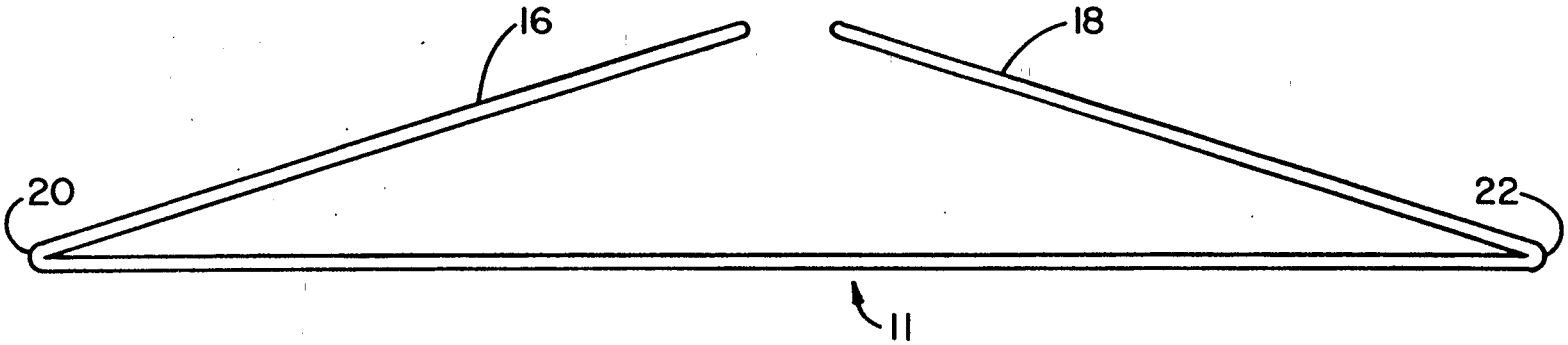
FIG. 2 is an end view of a brochure two thirds folded.

Referring to the drawings which will be described in terms of triple folding a brochure but which are also applicable to folding any semi-rigid, creaseable, sheet material which can be made to buckle, a folded brochure 10 comprises a paper sheet 11 having outer leaves 12 and 14 and inner leaves or inner panels 16 and 18. The general type of apparatus for making the folder 20, 22 and 24 is conventional as typified by the apparatus of the aforementioned patents, and comprises feed roller means, which in the exemplary embodiment shown, comprises roller pair 26 and 28 mounted for rotation on shafts 30 and 32 respectively in the directions indicated, at least one of which rollers is driven. These rollers preferably have an elastomeric type, friction generating surface. In a similar manner are provided first fold roller means comprising roller pair 28 and 34 at least one of which is driven, second fold roller means comprising rollers pair 36 and 38 at least one of which is driven, and third fold roller means comprising roller pair 38 and 40 at least one of which is driven. It is noted that rollers 28, 34, 36 and 38 are each common to two roller pairs and thus obviate the need for additional rollers and allow for more convenient and compact apparatus construction.

The first, second and third gate or channel members designated generally as 44, 46 and 48 respectively into which the sheet 11 is progressively propelled may be of typical construction and each comprises and upper guide plate 50 and a lower guide plate 52 providing channels 54, 56 and 58 respectively. Each gate member may be affixed to support members 60 which are parts of the folding machine base. Each gate member is provided with stop means such as pins or plates 62 spaced at proper positions along the axial length of the machine and which can be adjustably positioned in apertures or slots in the plates of the gate members to limit the distance to which a sheet can be inserted into its channel. In this manner, the precise location on trailing portion of the sheet which is to be buckled by the force of the advancing sheet can be set for a particular sheet to be folded. It is preferred that each gate member be provided with an adjustable upper guide segment 64 secured to its upper plate by bolt means 66 mounted through suitable adjusting slots 68 in bracket 70. These guide segments having their outer ends 72 extending at least substantially into the path of the advancing sheet can thus be adjusted to the best position to enhance entry of the sheet progressively and smoothly into the gates.

Figure 10:
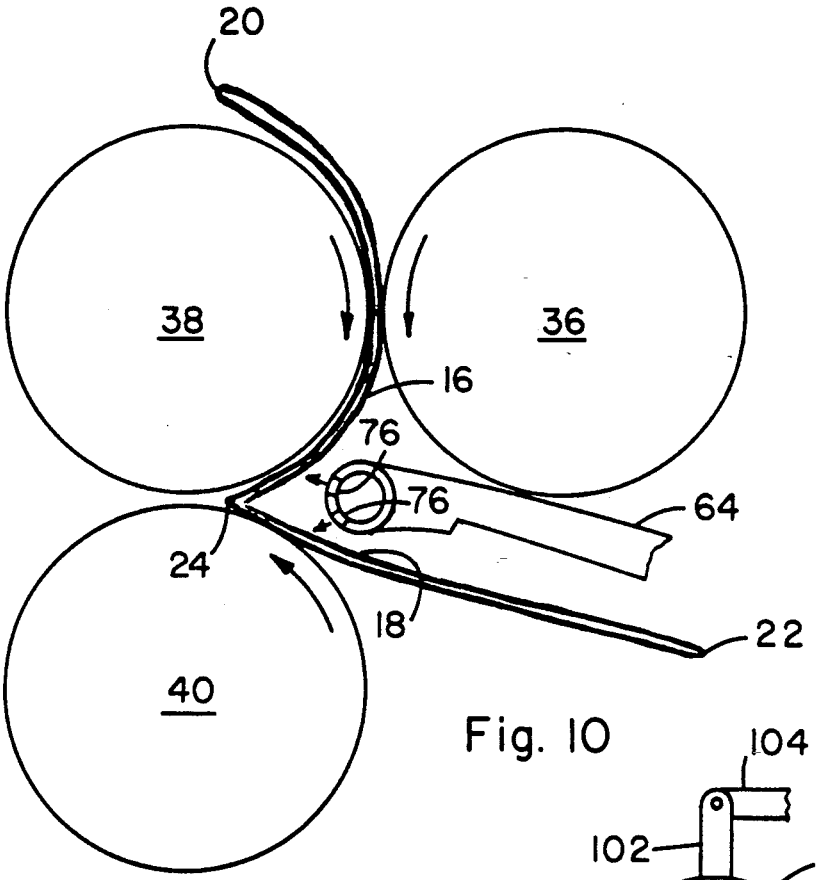
FIG. 10 is an enlarged view of the final buckling area.

The present air jet means, in a preferred embodiment, comprises a specially adapted outer end 72 of the third gate member 48, which end is specially formed of metal, plastic, or ceramic material to provide an air tube or plenum 74, preferably extending substantially the full length of the guide segments 64 or width of the machine. This plenum is provided with as many air jets (apertures) 76, of the appropriate size and location, as are necessary to provide adequate force to the free edges of panels 16 and 18 to urge them into the substantially flattened posture shown in FIG. 10. The size, number and location of the air jets, and the air pressure employed are all readily ascertainable by one skilled in the art in order to adapt the present invention to a particular buckle folding machine or job, e.g., paper of unusual stiffness or creaseability. Typically, for a variety of sheet materials a pressure of a few grams per $cm^3$ up to several $lbs/cm^3$ on the upper edge area of the panels is sufficient to maintain their position. In this regard, it may be advantageous, particularly for larger folding machines, to divide the plenum in the middle and connect each end with an air source. Also, the jets may be graduated up in size from the ends toward the middle of the plenum in order to compensate for air pressure drop. Air pressures in the plenum can range, e.g., from a few to 200 psi or more.

The plenum position, is in a preferred embodiment is adjustable by virtue of its mounting on bracket 70, such that the air jets can be directed in precisely the proper direction to force the free ends of the panels into their correct postures for entering the nip 41 of roller pair 38 and 40. In this regard, in order to further assist proper entry of the sheet into the gates, it is preferred to provide a thin metal or plastic guide sheet 78 affixed to the upper surface of each of the lower members 52 of the gates and extending substantially over the tops of the adjacent rollers such as to contact the leading portion of the sheet and direct it into the channel before it makes inopportune contact with the rollers.

Figure 3:
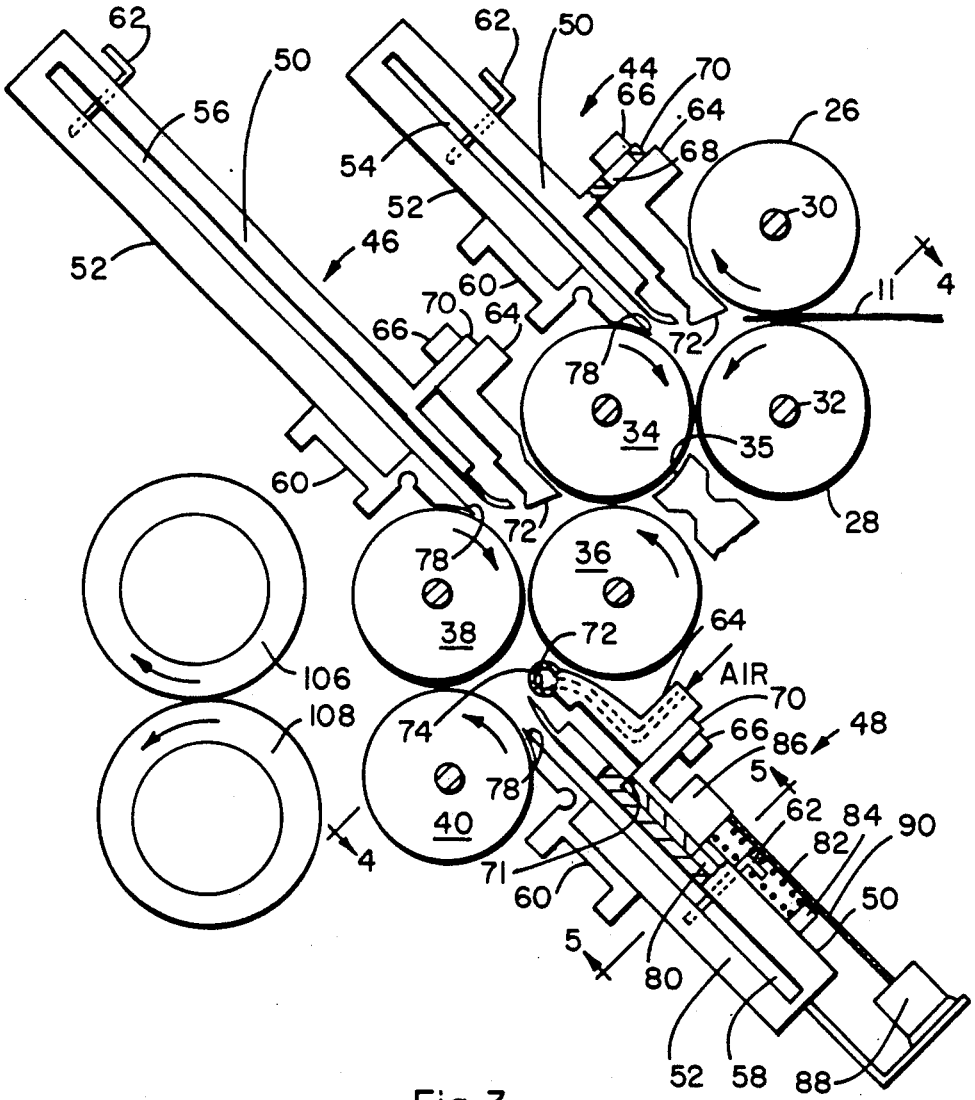
FIG. 3 is an end view, with portions in section of a typical triple fold, buckle folding machine provided with the air jet means of the present invention and showing a brochure blank being fed thereinto.
Figure 4:
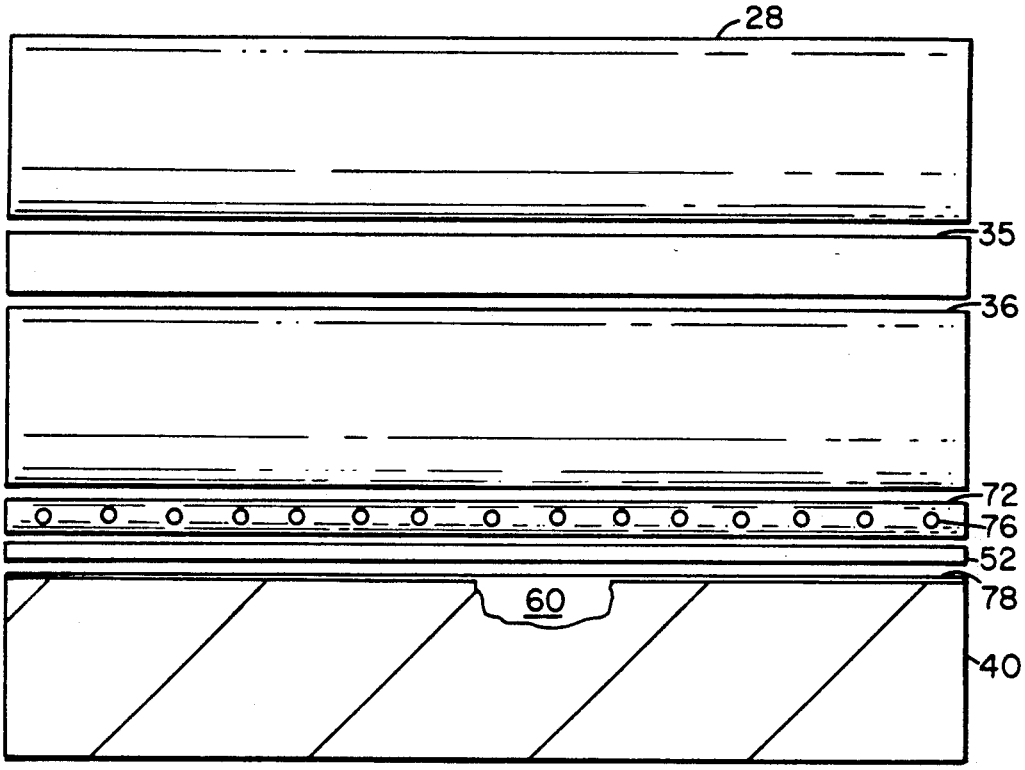
FIG. 4 is a partially cross-sectional view taken along line 4—4 of FIG. 3 in the direction of the arrows.
Figure 5:
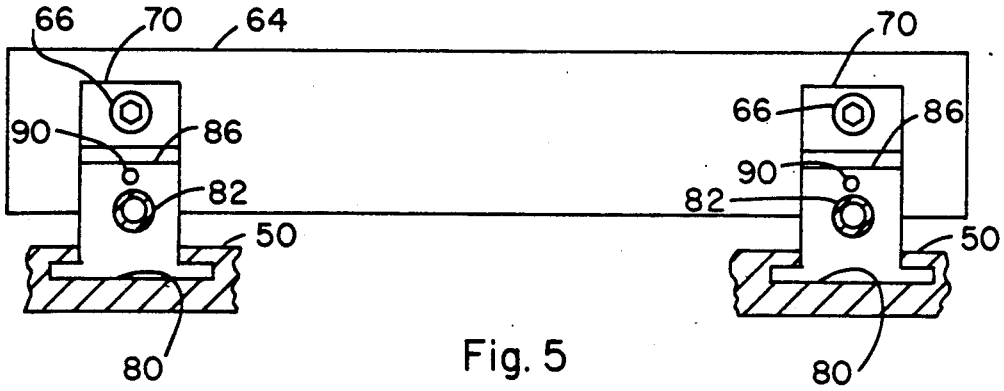
FIG. 5 is a cross-sectional view taken along line 5—5 of FIG. 3 in the direction of the arrows.
Figure 6:
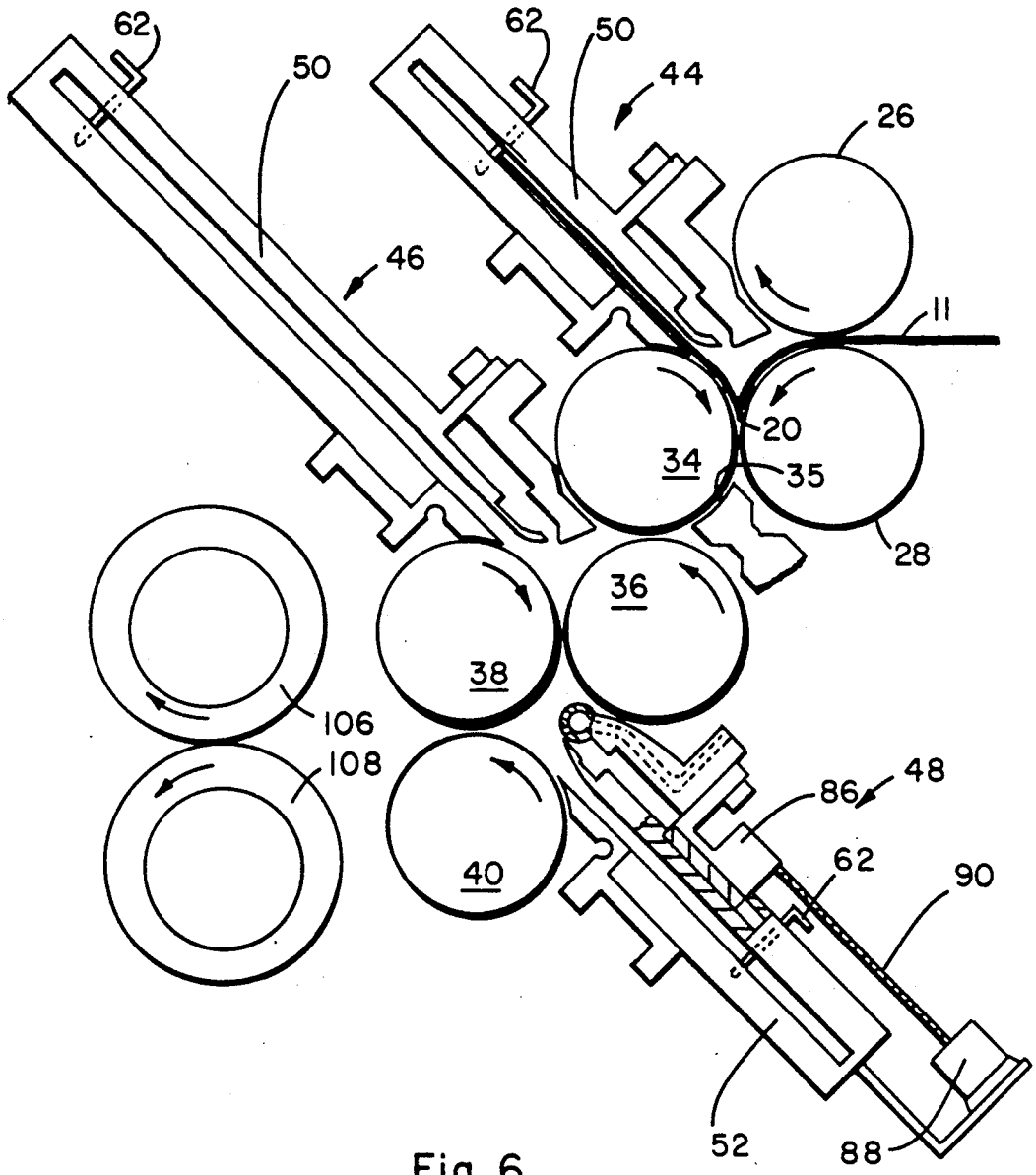
FIG. 6 is a view as in FIG. 3 showing the position of the brochure as the first buckle is being formed.
Figure 7:
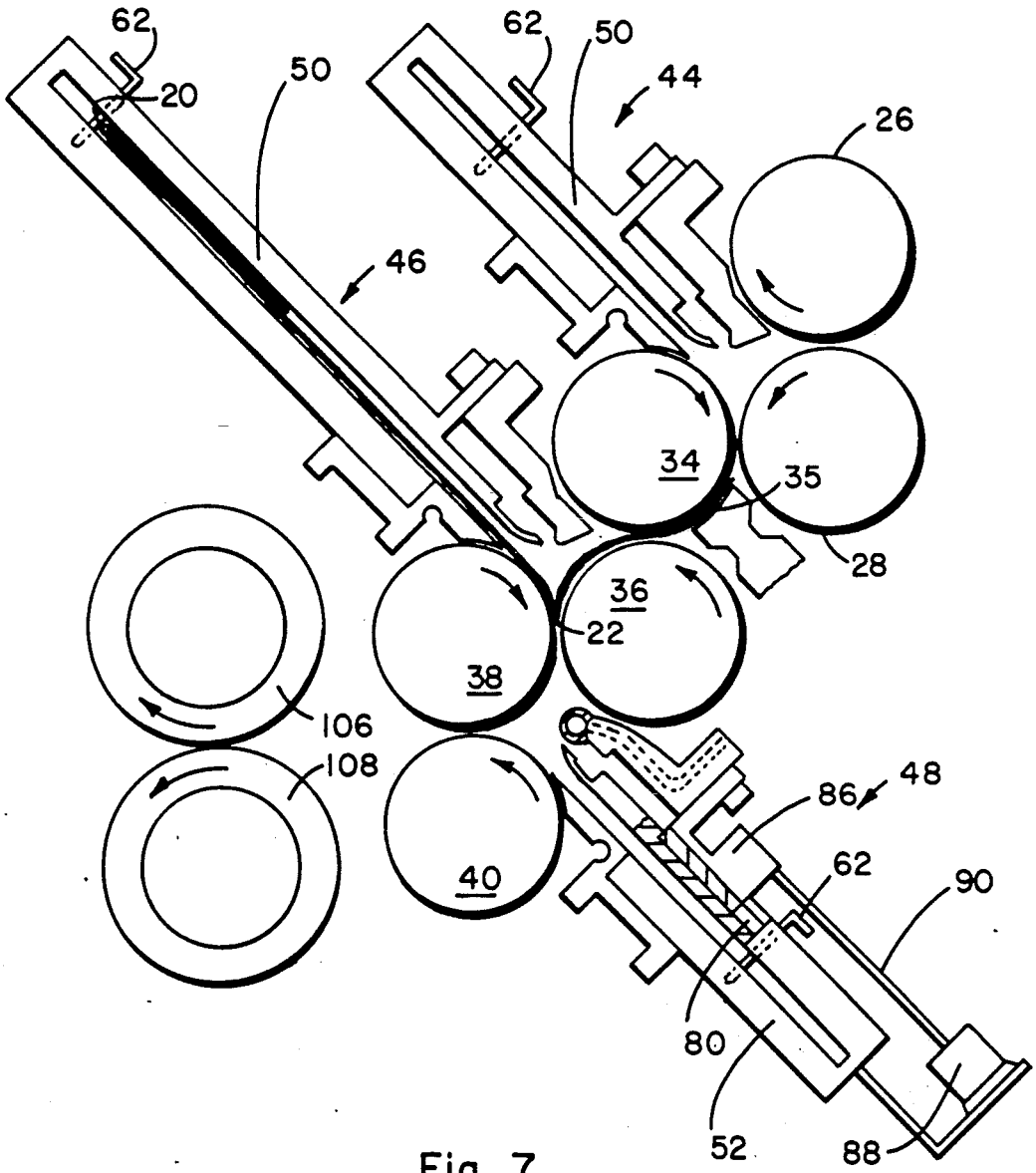
FIG. 7 is a view as in FIG. 3 showing the position of the brochure as the second buckle is being formed.

It is preferred that a means be provided for projecting the plenum further into the area of the third buckle at approximately the time that the second folded portion of the sheet has been fully inserted into gate 48, the purpose being to insure that adequate pressure is accurately applied to the panel edged at precisely the right time. It is noted in this regard, that where such projection and, of course, retraction of the plenum is provided for, a constant air pressure can be maintained in the plenum without causing directional distortion of the arriving sheet. The projection or forward movement of the plenum is provided, in the embodiment shown in FIGS. 3 and 5, by means of the bottom mounting of the two brackets 70 of gate 48 in slots 80 in the upper member 50 which allows the brackets to slide back and forth in response to actuation. Such actuation may be by any means such as compression spring 82 compressed between a fixed projection 84 on member 50 and projection 86 on the sliding bracket 70 and capable of rapidly moving bracket 70 inwardly against shoulder 71 which also may be made adjustable. After the free edges of the panels have been forced into proper position by the jetted air and are proceeding through the final fold roller pair 38 and 40, a power device such as solenoid 88 is energized to rapidly pull back or retract bracket 70 and attached plenum 74 by means of rod or cable 90 affixed to the solenoid armature and the bracket. Any type of power means may be employed however, to move the bracket back and forth including hydraulic or air pistons, or mechanical eccentrics or cams.

It is particularly noted that the mounting for the plenum is open to a variety of structures depending on the effect to be produced thereby. For example, the plenum may be constructed to give constant, uninterrupted air flow through the jets and may be stationary or retractable, or the plenum may be of the pulse air feed type and may be stationary or retractable.

Figure 11:
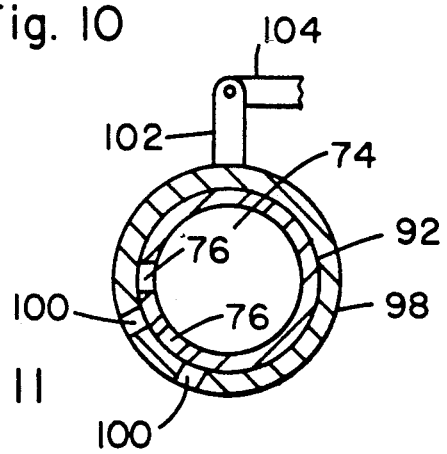
FIG. 11 is an enlarged cross-sectional view of a valved plenum.
Figure 12:
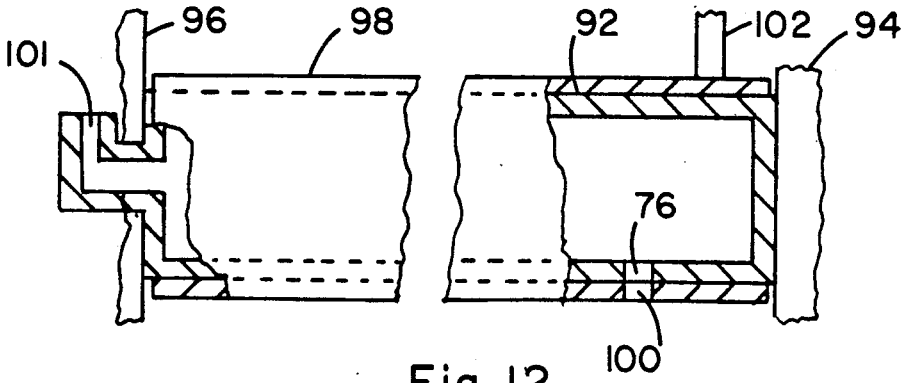
FIG. 12 is an enlarged longitudinal sectional view of the valved plenum of FIG. 11.

As shown in FIGS. 11 and 12, the air plenum 74 may be valved in any known manner, but a preferred construction therefor comprises a closed plenum tube 92 mounted on portions 94 and 96 of the folding machine base or supporting structure, and a valving tube 98 tightly but readily slidable, rotatably mounted on tube 92. Air jets 76 are provided in plenum tube 92 but are covered over by valving tube 98 until jetted air is required to force down the panel edges, at which time solenoid 88 or equivalent mechanism is actuated to rotate tube 98 such that its apertures 100 align with jets 76 to allow pressurized air fed through inlet 101 into tube 92 to emit from the jets. Rotation of tube 98 can be accomplished through any convenient means such as lever arm 102 affixed thereto and pivotally attached through a suitable linkage 104 to the solenoid armature. With this type of valving, the plenum does not have to be adapted for high frequency reciprocal motion. As indicated above however, the plenum may also be valved at its inlet or inlets such that air is essentially blasted into the plenum at the prescribed time to feed the jets.

Figure 8:
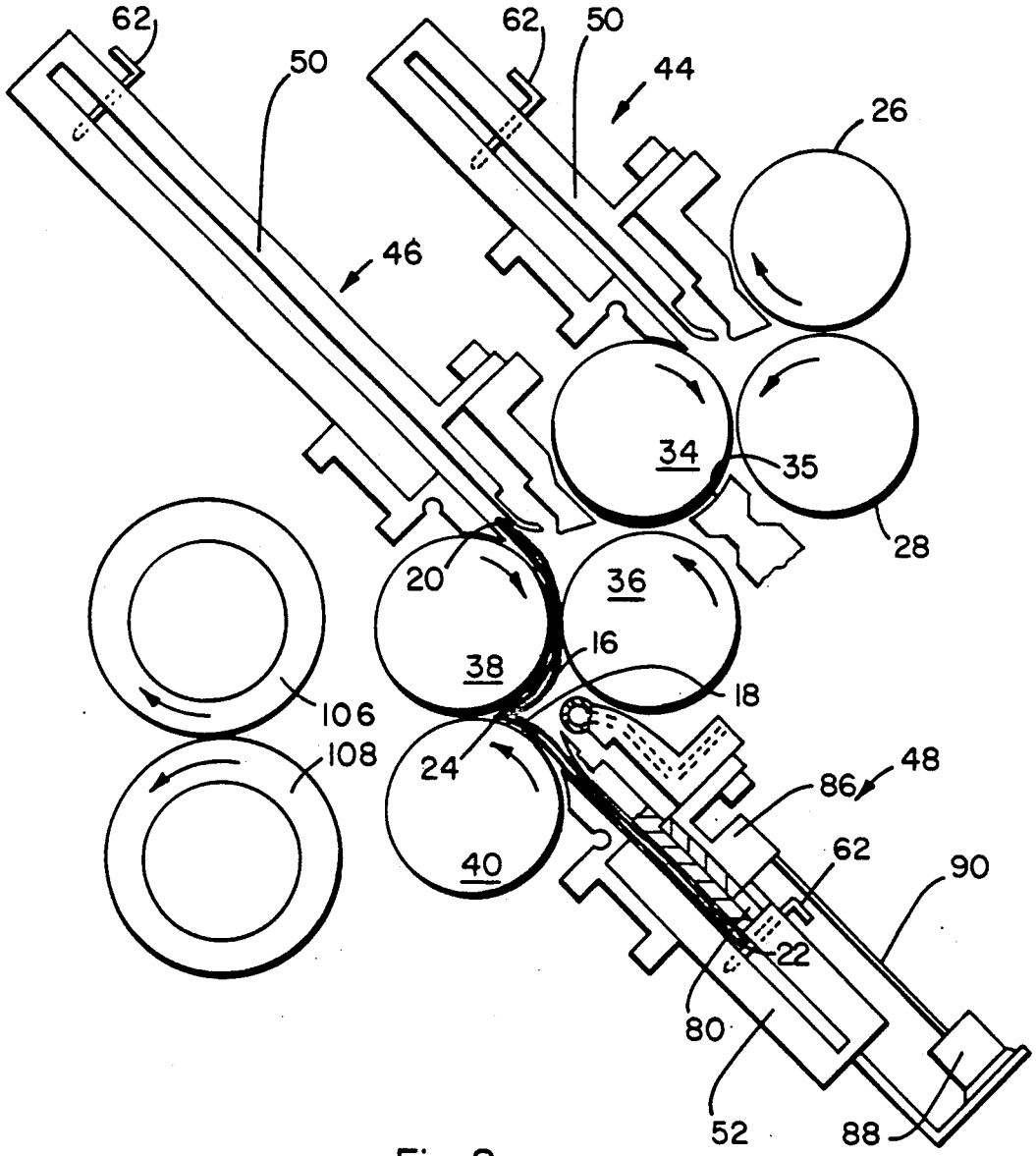
FIG. 8 is a view as in FIG. 3 showing the position of the brochure as the third buckle is being made.
Figure 9:
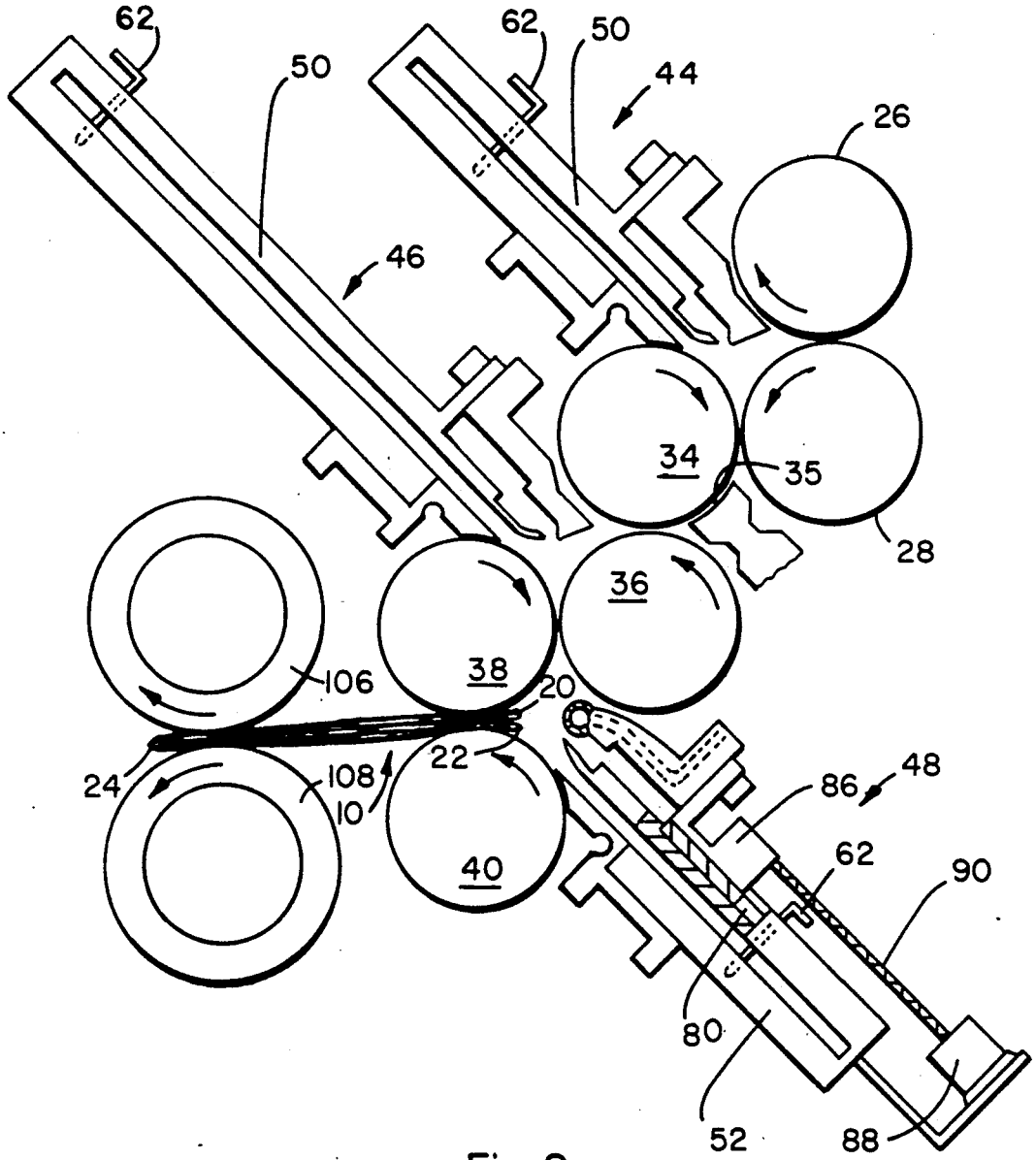
FIG. 9 is a view as in FIG. 3 showing the position of the brochure as it is exited from the apparatus on its way to stacking, slitting or other operations.

In FIGS. 6–9, the progress of sheet 11 through three buckling and folding operations are shown. It is seen that the buckling and folding operation of FIG. 8 is the one where the adjacent free ends of the panels, if they are not forced against the underlying sheet, can create the problems heretofore mentioned. Referring to FIGS. 6–9, the sheet 11 is propelled by feed roller pair 26/28 into the first gate member to form first buckle 20. The sheet with buckle 20 leading is dragged by and between first fold roller pair 28/34, against and past deflector bar 36 (see FIG. 7), through roller pair 34/36, and into gate 46 to form second buckle 22. The sheet with buckle 22 leading is dragged by and between second fold roller pair 36/38 with buckle 22 leading, into gate 48 to the position wherein it is stopped by 62 and buckle 24 is formed. Either slightly before, or during or slightly after the sheet is so stopped, plenum 74 is propelled forward to jet air against the adjacent edges of the panels 16 and 18 to keep them in proper position for entry between third fold roller pair 38/40 at nip 41. These jets are maintained in their operative positions at least until roller pair 38/40 at nip 41 engages the third buckle 24 and begins to drag the sheet therebetween. It is noted, that with the present air jets, the panels 16 and 18 can be dimensioned to essentially cover the full width of the brochure, without the need for any gapping of their adjacent edges for the purpose of preventing dog-earring or the like. As described above, regarding FIGS. 11 and 12, valving of the plenum may used to obviate the reciprocating the plenum. The completely folded sheet is then exited from the folding operation by roller pair 38/40 at nip 41 as shown in FIG. 9 and may be fed thereby to another operation such as slitter wheels, embossing rollers, or the like 106 and 108.

Figure 13:
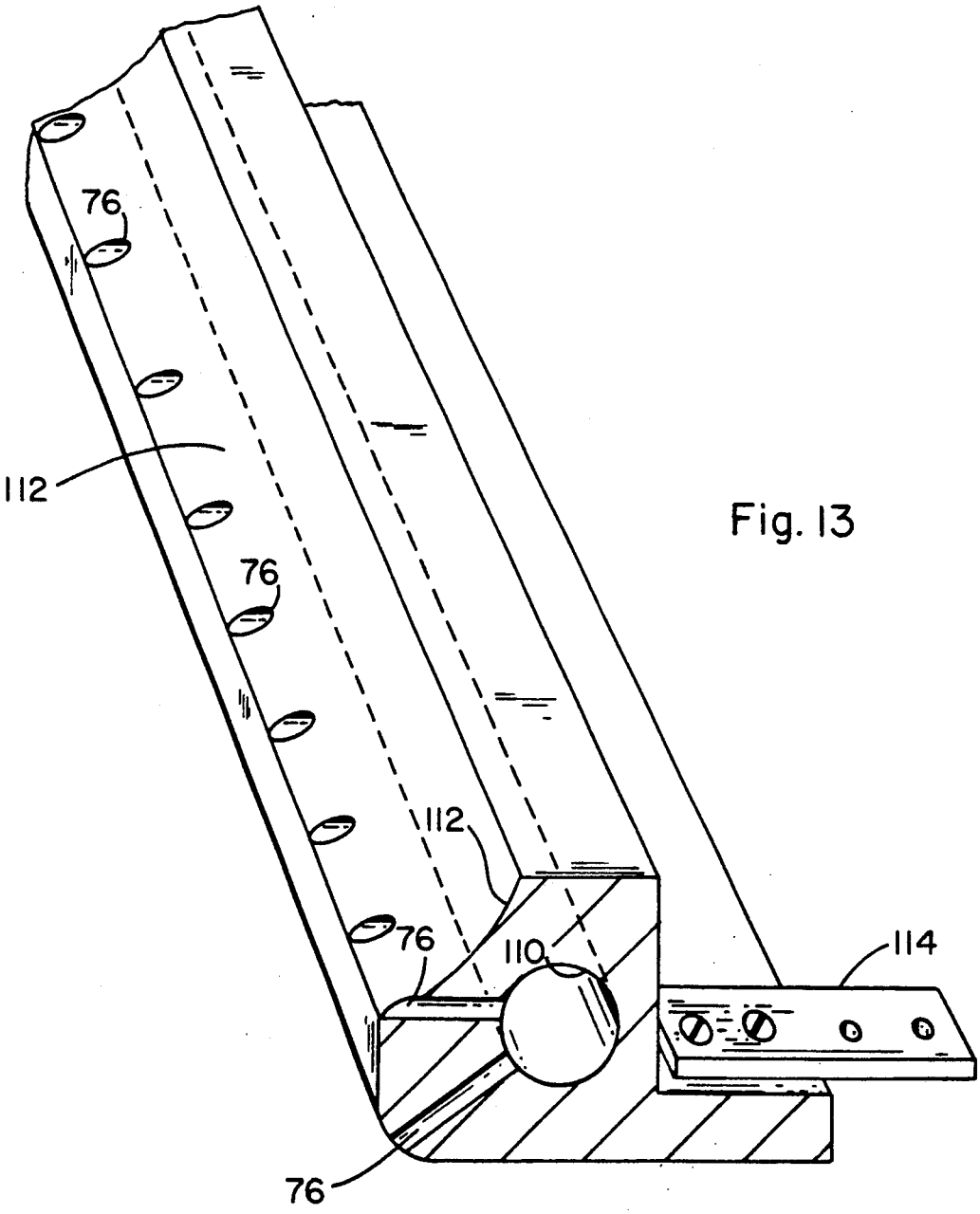
FIG. 13 is an isometric view of a portion of a preferred air jet tube, in partial section.

Referring to FIG. 13, one preferred configuration of the air jet tube is shown as having a bored or extruded air plenum 110 extending the full length thereof and capped at both ends to provide the air-tight tube. Suitable air inlet fittings are provided at one or both ends in known manner. One feature of this configuration is the scalloped or concave leading portion 112 of the tube which has been found to greatly assist in directing the sheet into gate 48. The mounting tabs 114 can be secured to the machine base in a stationary manner or, where inner-outer (retractable) motion of the plenum is desired, the tabs can be affixed in any suitable manner to slidable brackets such as 70.

The invention has been described in detail with particular reference to preferred embodiments thereof, but it will be understood that variations and modifications will be effected within the spirit and scope of the invention.

I claim:

1. A sheet folding apparatus having feed roller means for grasping and propelling a sheet forward, first gate means for receiving a leading portion of said propelled sheet and stopping the same at a predetermined distance therein to cause a first buckle to form in the trailing portion of said sheet, first fold roller means for grasping said sheet at said first buckle to effect a first fold and a first inner panel and propelling said sheet with said first fold leading into second gate means adapted to stop the same at a predetermined distance therein to cause a second buckle to form in the trailing portion of said sheet, second fold roller means for grasping said sheet at said second buckle to effect a second fold and a second inner panel with the inner edges of said panels being juxtaposed and propelling said sheet with said second buckle leading into third gate means adapted to stop the same at a predetermined distance therein to cause a third buckle to form in the trailing portion of said sheet intermediate said panel inner edges, third fold roller means for grasping said sheet at said third buckle to effect a third fold and propelling said sheet with said third fold leading through the exit of the folding operation, air jet means, mounting means on said apparatus for movably supporting said jet means and for selectively positioning the same in close proximity to said inner edges of said panels and adjacent the nip of said third fold roller means, and valving means on said apparatus for said air jet means for applying air pressure to said inner edges of said panels in a direction tending to force them flat against the underlying sheet portion only during the period that said third buckle and third fold are being formed.

2. The apparatus of claim 1 wherein said jet means comprises an air plenum tube running substantially the full width of the machine.

3. The apparatus of claim 2 wherein said plenum tube is divided substantially in the middle and each outer end of which is provided with an air inlet.

4. The apparatus of claim 1 wherein the forward portion of said jet means is provided with a concave surface for contacting and guiding the leading portions of the trailing panel into the final fold rollers.

5. A sheet folding apparatus having feed roller means for grasping and propelling a sheet forward, first gate means for receiving a leading portion of said propelled sheet and stopping the same at a predetermined distance therein to cause a first buckle to form in the trailing portion of said sheet, first fold roller means for grasping said sheet at said first buckle to effect a first fold and a first inner panel and to propel said sheet with said first fold leading into second gate means adapted to stop the same at a predetermined distance therein to cause a second buckle to form in the trailing portion of said sheet, second fold rolled means for grasping said sheet at said second buckle to effect a second fold and a second inner panel with the inner edges of the folded panels lying in close proximity to each other, and to propel said sheet with said second fold leading into third gate means adapted to stop the same at a predetermined distance therein to cause a third buckle to form in the trailing portion of said sheet intermediate said panel inner edges, third fold roller means for grasping said sheet at said third buckle to effect a third fold and propel said sheet with said third fold leading through the exit of the folding operation, air jet means mounted on said apparatus for rapid movement into and from a position adjacent said panel inner edges proximate in time and place to entry of said third buckle into the nip of said third fold roller means, and valving means for said air jet means for applying air pressure to said panel inner edges in a direction tending to force them against the underlying sheet portion only during the period that said third buckle is being formed and is being engaged by said third fold roller means.

6. The apparatus of claim 5 wherein said mounting means is provided with solenoid means which provides the force for moving said jet means into position for applying the air pressure to said inner edges of said panels.

7. The apparatus of claim 6 wherein spring means is provided on said mounting means for retracting said jet means from its operative position when said solenoid means is deenergized.

8. A sheet folding apparatus having feed roller means for grasping and propelling a sheet forward, first gate means for receiving a leading portion of said propelled sheet and stopping the same at a predetermined distance therein to cause a first buckle to form in the trailing portion of said sheet, first fold roller means for grasping said sheet at said first buckle to effect a first fold and a first inner panel and to propel said sheet with said first fold leading into second gate means adapted to stop the same at a predetermined distance therein to cause a second buckle to form in the trailing portion of said sheet, second fold roller means for grasping said sheet at said second buckle to effect a second fold and a second inner panel with the inner edges of the folded panels being in juxtaposition, and to propel said sheet with said second fold leading into third gate means adapted to stop the same at a predetermined distance therein to cause a third buckle to form in the trailing portion of said sheet intermediate said panel inner edges, third fold roller means for grasping said sheet at said third buckle to effect a third fold and propel said sheet with said third fold leading through the exit of the folding operation, air jet means mounted on said apparatus for rapid retraction from the path of a sheet entering said third gate means, and for subsequent rapid movement into adjacency to said panel inner edges proximate to entry of said third buckle into the nip of said third fold roller means, said roller nip lying intermediate said second fold roller means and said third gate means, and valving means for said air jet means for applying jetted air to said panel inner edges in a direction tending to force them against the underlying sheet portion only during the period that said third buckle is being formed and is being engaged by said third fold roller means.

* * * * *